United States Patent [19]

Anno et al.

[11] Patent Number: 4,980,257

[45] Date of Patent: Dec. 25, 1990

[54] ELECTROSTATIC LATENT IMAGE DEVELOPING TONER AND METHOD FOR PRODUCTION THEREOF

[75] Inventors: Masahiro Anno; Junji Machida; Eiichi Sano, all of Osaka, Japan

[73] Assignee: Minolta Camera Kabushiki Kaisha, Osaka, Japan

[21] Appl. No.: 301,719

[22] Filed: Jan. 26, 1989

[30] Foreign Application Priority Data

Jan. 29, 1988 [JP] Japan ..... 63-20944

[51] Int. Cl.[5] ..... G03G 9/093

[52] U.S. Cl. ..... 430/110; 430/109; 430/138; 428/407

[58] Field of Search ..... 430/109, 110, 138

[56] References Cited

U.S. PATENT DOCUMENTS

| | | | |
|---|---|---|---|
| 4,336,173 | 6/1982 | Ugelstad | 523/205 |
| 4,459,378 | 7/1984 | Ugelstad | 523/205 |
| 4,601,967 | 7/1986 | Suzuki et al. | 430/107 |
| 4,803,144 | 2/1989 | Hosoi | 430/138 X |

FOREIGN PATENT DOCUMENTS

| | | | |
|---|---|---|---|
| 0266175 | 5/1988 | European Pat. Off. | 430/138 |
| 56-55954 | 5/1981 | Japan | 430/110 |
| 5937553 | 8/1982 | Japan . | |
| 61-99154 | 5/1986 | Japan | 430/109 |
| 62-75541 | 4/1987 | Japan . | |
| 62-226162 | 10/1987 | Japan . | |
| 62-283346 | 12/1987 | Japan | 430/109 |
| 63-39051 | 8/1988 | Japan | 430/109 |

*Primary Examiner*—Roland E. Martin

*Attorney, Agent, or Firm*—Burns, Doane, Swecker & Mathis

[57] ABSTRACT

In an electrostatic latent image developing toner which comprises spherical core particles composed of at least a coloring agent and a thermoplastic resin and an outer shell layer containing at least a thermoplastic resin and applied in the form of a coating fast to the core particles, the outer shell layer applied in the form of a coating is formed by (a) thermally fixing minute particles of one thermoplastic resin and minute particles of another thermoplastic resin on the surface of the core particles thereby enabling part of the aforementioned other thermoplastic resin to retain the original particulate form thereof intact in the produced coating or (b) thermally fixing minute particles of a thermoplastic resin and minute particles of a thermosetting resin or minute particles of a resin possessing a gelling component in a specific amount on the surface of the core particles thereby enabling the minute particles of the resin to retain the original particulate form thereon intact in the produced coating and impart a minutely rugged surface to the coating.

21 Claims, No Drawings

ELECTROSTATIC LATENT IMAGE DEVELOPING TONER AND METHOD FOR PRODUCTION THEREOF

BACKGROUND OF THE INVENTION

1. Field of the Invention

This invention relates to an electrostatic latent image developing toner and a method for the production thereof. More particularly, it relates to a toner to be used in the development of electrostatic latent images in electrophotography, electrostatic recording, and electrostatic printing and to a method for the production of the toner.

2. Description of the Prior Art

The development of electrostatic latent images in electrophotography, electrostatic recording, and electrostatic printing is effected by causing a triboelectrified toner to be electrostatically deposited on an electrostatic latent image formed on a sensitive material thereby converting the latent image into a visible image.

As means of charging the toner to be used in the development of the electrostatic latent image, the two-component developing method is known to attain the impartation of charge by mixing and stirring the toner with a substance generally called a carrier and the one-component developing method is known to effect the impartation of charge by exposing the toner to contact with a developing sleeve or a toner regulating blade. No matter whichever of these methods may be used, if the charge is not imparted uniformly, problems arise during the course of development and transfer of an image.

Heretofore, the dry toner has been generally produced by a method which comprises mixing a pigment such as carbon black with a thermoplastic resin, melting and kneading the mixture thereby forming a uniform dispersion, and thereafter comminuting the dispersion with a suitable finely dividing apparatus into a powder possessing a particle diameter required of a toner. The individual particles of the toner produced by this comminution method have no fixed shape. This fact tends to cause agglomeration of toner particles, possibly functions as an adverse factor on the stability of toner during storage, the dispensing property of toner during supply, and the clarity and sharpness of a developed image, and brings about a serious problematic effect on the quality of the image to be actually obtained, particularly in terms of resolving power, clarity and sharpness, and fogging.

In recent years, the electrostaic latent image developing toner has been urged to fulfil the requirement that it should warrant production of an image of high fineness of delineation for the sake of repeatability of lines and the requirement that it should be capable of producing an image of high quality in terms of mesh-pattern reproducibility, halftone reproducibility, tonality, and resolving power. To meet these requirements, the toner particles are desired to be amply decreased in diameter. This decrease in diameter of the toner particles, however, goes on the other hand to impair the powder properties such as flowability which are to be displayed by the toner itself or the mixture of the toner with a carrier in the case of two-component developing method. When this decrease of particle diameter is tried on the toner which is obtained by the comminution method described above and, threfore, composed of particles devoid of a fixed shape and wide in diameter distribution, the produced toner suffers from extreme impairment of flowability. Even if the toner is made to incorporate therein a large amount of a suitable after treating agent for enhancing flowability, the incorporation of this agent entails such secondary effects as defective electrification and serious aggravation of toner-scattering.

In contrast to the toner which is produced by the comminution method described above, the toner which is produced by the so-called suspension polymerization method, i.e. by polymerizing a polymer composition composed of a polymerizable monomer, a polymerization initiator, and a coloring agent as suspended in a non-solvent type dispersion medium, as disclosed in Japanese Patent Publication SHO No. 36(1961)-10,231, Japanese Patent Publication SHO No. 43(1968)-10,799, and Japanese Patent Publication SHO No. 51(1976)-14,895, for example, has been also known to the art. This suspension polymerization method is advantageous from the productional point of view because it has no use for any step of comminution. The toner obtained by this method is composed of spherical particles and is generally said to exhibit highly desirable flowability. Since the toner obtained by the suspension polymerization method comprises spherical particles of smooth surface and, therefore, has a smaller surface area than the toner obtained by the comminution method and, consequently, composed of particles devoid of a fixed shape, it is deficient in the toner charging property, a factor dependent on the surface area of toner particles. As the result, poor electrification-build-up, insufficiency of the absolute charge amount of toner and broadening of charge distribution are produced, thereby entailing such adverse phenomena as drifting of toner particles and fogging of the produced image. Further, owing to the sphericity of the toner particles, the toner particles exhibit high adhesiveness to the sensitive material and adhere fast to the sensitive material and also exhibit ready rollability as compared with the toner particles lacking a fixed shape and defy effective removal from the sensitive material during the course of the cleaning treatment.

For the purpose of producing a toner endowed with a composite construction and consequently enabled to discharge separate functions, Japanese Patent Publication SHO No. 59(1984)-38,583 discloses a toner which has a coating layer formed of minute particles by emulsion polymerization and deposited wet on the surface of core particles and Japanese Patent Laid-Open SHO No. 62(1987)-226,162 discloses a toner which is produced by depositing minute resin particles wet on the surface of colored thermoplastic resin cores and subsequently heat-treating the resultant composite cores, for example. These toners invariably embody an idea of harnessing the fact that the electrical properties of a toner depend mainly on the surface portion of toner particles, specifically by depositing minute resin particles on the surface of core particles containing a coloring agent, a magnetic substance, etc. thereby enabling the deposited minute resin particles to improve the surface properties of the core particles and allowing the core particles to acquire a roughened surface, an increased surface area, an increased friction coefficient, and improved charging property. The minute resin particles deposited wet as described above, however, are separated easily from the core particles and, therefore, do not bring about the improvement of surface properties fully as claimed. Further, in the layer of minute resin particles deposited wet as described above, the minute resin particles are deposited as retaining their original particulate form intact on the surface of the core particles as clearly shown in the electron micrograph attached to the specificaiton of Japanese Patent Laid-Open SHO No. 62(1987)-226,162. The coating layer as such, therefore, does not completely cover the surface of the core particles (i.e. the coating layer lacks a compact texture). The toner consequently has a strong possibility of being prevented from acquiring a stable charging property by the influences of the coloring agent, magnetic powder, etc. contained in the core particles. Particularly when the toner has been stored or used under harsh temperature conditions, the components making up the core particles are suffered to pass through the gaps between the minute resin particles and finally exude from the surface of the toner to exert still more serious influences. Incidentally, this exudation of the components of the core particles to the toner surface concurrently entails agglomeration of toner particles as a problem.

Further, in the case of the pressure fixing capsulated toner, apart form the thermally fixing toner, improvements for surface properties have been proposed. Japanese Patent Laid-Open SHO No. 62(1987)-75,541, for example, discloses a pressure fixing capsulated toner which attains the improvement by forming a rugged surface on hard film shells enclosing pressure fixing cores. Generally, in the pressure fixing capsulated toner, the particles of this toner have a spherical form and a smooth surface, similarly to the thermally fixing toner obtained by the suspension polymerization described above and, therefore, entails such drawbacks as instability of charging property, pollution of the sensitive material, and poor cleaning property. The toner disclosed in the specification mentioned above, therefore, is aimed at overcoming these drawbacks by providing a rugged surface of the toner particles. As indicated in the specification, the rugged surface is formed by first depositing minute particles of silica, for example, on the surface of cores and subsequently forming a shell layer by the phase-separation method. By this procedure, however, the rugged surface cannot be formed easily because the degree of ruggedness tends to be influenced by the thickness of the shell layer and the minute particles are embedded completely by the shell layer if the shell layer has a large thickness. Conversely, if the shell layer has a small thickness, the minute particles deposited for the formation of a rugged surface tend to come off the surface and do not improve the surface properties sufficiently.

An object of this invention, therefore, is to provide a novel electrostatic latent image developing toner.

An another object of this invention is to provide an electrostatic latent image developing toner possessing not only stable charging property and high cleaning property but also high flowability.

A further object of this invention is to provide an electrostatic latent image developing toner which retains powder properties such as flowability, charging property, developing power, and cleaning property stably even when the particle diameter thereof is decreased enough to enhance the fineness of delineation for the sake of reproducibility of lines and improve the image quality in terms of granularity, mesh-pattern reproducibility, halftone reproducibility, tonality, and resolving power.

SUMMARY OF THE INVENTION

The objects described above are accomplished by an electrostatic latent image developing toner comprising spherical core particles composed of at least a coloring agent and a thermoplastic resin and an outer shell layer containing at least a thermoplastic resin and applied in the form of a coating fast to the core particles, the outer shell layer applied in the form of a coating is formed by thermally fixing minute particles of a first thermoplastic resin and minute particles of a second thermoplastic resin satisfying the following conditional formulas I to IV on the surface of the core particles thereby enabling part of the minute particles of the second thermoplastic resin to retain the original particulate form thereof intact in the produced coating and impart a minutely rugged surface to the coating.

$$-0.2 \leqq R \leqq 0.6 \quad \text{(I)}$$

$$-15 \leqq Tm \leqq 100 \quad \text{(II)}$$

$$-4 \leqq \Delta gel \leqq 60 \quad \text{(III)}$$

$$|100\,R + \Delta Tm + 4\,\Delta gel| \geqq 20 \quad \text{(IV)}$$

providing that in the expressions $$R = (R_2 - R_1)/(R_2 + R_1)$$

$$\Delta Tm = Tm_2 - Tm_1$$

$$\Delta gel = gel_2 - gel_1$$

$R_1$ and $R_2$ are average particle diameters (micron) respectively of the minute particles of the first thermoplastic resin and the minute particles of the second thermoplastic resin, $Tm_1$ and $Tm_2$ are the softening points (°C.) respectively of the minute particles of the first thermoplastic resin and the minute particles of the second thermoplastic resin, and $gel_1$ and $gel_2$ are amounts of gel formed (% by weight) respectively of the minute particles of the first thermoplastic resin and the minute particles of the second thermoplastic resin.

The objects described above are further accomplished by an electrostatic latent image developing toner comprising spherical core particles composed of at least a coloring agent and a thermoplastic resin and an outer shell layer containing at least a thermoplastic resin and applied in the form of a coating fast to the core particles, the fact that the outer shell layer is formed by thermally fixing minute particles of a thermoplastic resin and minute particles of a thermosetting resin or minute particles of a resin having a gelling component (gel) in an amount in the range of $60 < gel < 100$ on the surface of the core particles thereby enabling the minute particles of the thermosetting resin or the minute particles of the resin having a gelling component (gel) in an amount in the range of $60 < gel < 100$ to retain the original particulate form thereof intact in the produced coating and impart a minutely rugged surface to the coating.

The objects are also accomplished by a method for the production of an electrostatically latent image developing toner comprising a step of causing minute particles of a first thermoplastic resin and minute particles of a second thermoplastic resin satisfying the following conditional formulas I to IV to be deposited fast by the agency of Van der Waals force and electrostatic force on the surface of spherical core particles comprising at least a coloring agent and a thermoplastic resin and a step of melting the surface of the deposited minute particles of thermoplastic resin with a mechanical shearing force and consequently forming an outer shell layer having the minute particles of the second thermoplastic resin retained in the original particulate form thereof intact therein:

$$-0.2 \leqq R \leqq 0.6 \quad \text{(I)}$$

$$-15 \leqq \Delta Tm \leqq 100 \quad \text{(II)}$$

$$-4 \leqq gel \leqq 60 \quad \text{(III)}$$

$$|100\,R + \Delta Tm + 4\,\Delta gel| \geqq 20 \quad \text{(IV)}$$

providing that in the expressions $$R = (R_2 - R_1)/(R_2 + R_1)$$

$$\Delta Tm = Tm_2 - Tm_1$$

$$\Delta gel = gel_2 - gel_1$$

$R_1$ and $R_2$ are average particle diameter (micron) respectively of the minute particles of the first thermoplastic resin and the minute particles of the second thermoplastic resin, $Tm_1$ and $Tm_2$ are the softening points (°C.) respectively of the minute particles of the first thermoplastic resin and the minute particles of the second thermoplastic resin, and $gel_1$ and $gel_2$ are amounts of gel formed (% by weight) respectively of the minute particles of the first thermoplastic resin and the minute particles of the second thermoplastic resin.

The objects described above are accomplished by a method for the produciton of an electrostatic latent image developing toner comprising a step of causing minute particles of a thermoplastic resin and minute particles of a thermosetting resin or minute particles of a resin having a gelling component (gel) in an amount in the range of $60 < gel < 100$ to be deposited fast by the agency of Van der Waals force and electrostatic force on the surface of spherical core particles comprising at least a coloring agent and a thermoplastic resin and a step of melting the surface of the deposited minute particles of thermoplastic resin with a mechanical shearing force and consequently forming an outer shell layer having the minute particles of the thermosetting resin or the minute particles of the resin having a gelling component (gel) in an amount in the range of $60 < gel < 100$ retained in the original particulate form thereof intact therein.

Furhter the objects described above are accomplished by a method for the production of an electrostatic latent image developing toner comprising a step of causing minute particles of a thermoplastic resin to be deposited fast by the agency of Van der Waals force and electrostatic force on the surface of spherical core particles comprising at least a coloring agent and a thermoplastic resin, a step of melting the surface of the deposited minute particles of thermoplastic resin with mechanical shearing force thereby forming an outer shell layer in the form of a coating, a step of causing minute particles of a thermosetting resin or minutes particle of a resin having a gelling component (gel) in an amount in the range of $60 < gel < 100$ to be deposited fast by the agency of Van der Waals force and electrostatic force on the surface of the outer shell layer in the form of a coating, and a step of causing the deposited minute particles of the thermosetting resin or minute particles of the resin having a gelling component (gel) in an amount in the range of $60 < gel < 100$ to be fixed by the force of mechanical imapct on the outer shell layer in the form of a coating.

EXPLANATION OF PREFERRED EMBODIMENT

Now the present invention will be described more specifically below with reference to working embodiments.

In the electrostatic latent image developing toner of the present invention, the core particles are spherical particles comprising at least a coloring agent and a thermoplastic resin and optionally incorporating therein a mold release agent and other similar agents useful for the improvement of toner properties.

The construction of the core particles has no specific restriction except for the sole requirement that the core particles should comprise at least a coloring agent and a thermoplastic resin component. A variety of embodiments are conceivable. As concerns the disposition of the coloring agent, for example, the core particles in their complete form may be obtained by either incorporating the coloring agnet in the thermoplastic resin composition and then forming the resin composition in a prescribed shape or forming core particles with the thermoplastic resin not containing the coloring agent and then coating the core particles with a layer containing the coloring agent. In the two embodiments of the construction of the core particles described above, the embodiment which comprises forming core particles with the thermoplastic resin containing no coloring agent and coating the core particles with a layer containing the coloring agent proves to be particularly desirable in respect that spherical resin particles of a stable composition can be easily produced and the coloring agent can be easily altered in kind and amount to meet a varying use to be found for the toner.

Where the toner is to be finally produced as a magnetic toner, the core particles and/or the layer of coloring agent may incorporate therein a magnetic powder such as gamma-hematite, magnetite, or ferrite.

The core particles need not be produced by any specific method but may be produced any of the known methods heretofore generally employed for the production of spherical toner particles. These known methods include pelletizing polymerization methods such as emulsion polymerization method and suspension polymerization method and wet pelletizing methods such as suspension method and spray drying method, for example.

To be more specific, where the core particles are to be produced by emulsion polymerization, since the emulsion polymerization in popular use are capable of only producing extermely minute particles in spite of the desirability in terms of particle diameter distribution, it is desirable to employ a method known as seed polymerization. The seed polymerization, as disclosed in Japanese Patent Publication SHO No. 57(1982)-24,369, for example, comprises stirring and emulsifying part of a polymerizable monomer and a polymerization initiator in an aqueous medium or an emulsifier-containing aqueous medium, then gradually adding the remaining part of the polymerizalbe monomer dropwise to the aqueous medium thereby giving rise to minute particles therein, and allowing either a polymerizable monomer having a coloring agent dissolved or dispersed therein or a polymerizable monomer containing no coloring agent to be polymerized in liquid drops with the minute particles as seeds. The particles produced by this polymerization as containing the coloring agent therein can be used directly as core particles. The particles produced by the polymerization in a state not containing the coloring agent have a layer of the coating agent formed on the surface therefor before they are used as core particles.

Where the core particles are to be produced by suspension polymerization, this suspension polymerization is effected by causing either a polymerizable monomer having a coloring agent dissolved or dispersed therein or a polymerizable monomer containing no coloring agent to be dispersed in a non-solvent type medium and polymerizing the dispersed liquid drops with a polymerization initiator easily soluble in the polymerizable monomer and sparingly soluble in the dispersion medium. Again in this case, the particles produced by the polymerization in a state containing the coloring agent can be used directly as core particles, whereas the particles produced by the polymerization in a state not containing the coloring agent have a layer of the coloring agent formed on the surface thereof before they are used as core particles.

The suspension method produces the core particles by dissolving the thermoplastic resin containing or not containing a coloring agnet or other substance and suspending the molten thermoplastic resin in an aqueous medium and the spray drying method produces the core particles by dissolving the thermoplastic resin in combination with the coloring agent or the thermoplastic resin component alone in a solvent and then spray drying the dissolved resin component. In either of these case described above, before they are used as core particles.

The shape and particle diameter distribution of the core particles determine the shape and particle diameter distribution of finally produced toner particles in a great measure and affect the flowability and charging amount of the toner particles. The resin particles as such core particles are desired to possess high sphericity and a narrow particle diamter distribution. Among other pelletizing polymerization methdos mentioned above, the method known as seed polymerization easily produces particles possessing high sphericity and a narrow particle diameter distribution and permits easy control of the polymerization degree. Thus, the core particles obtained by the seed polymerization turn out to be highly desirable resin particles.

In the embodiment in which the core particles are obtained by forming a layer of a coloring agent on the surface of core particles of resin, the method to be used for the formation of the layer of coloring agent on the surface of the core particles is not particularly restricted. The layer of coloring agent may be formed, for example, by causing the coloring agent alone to be applied fast wet or dry to the surface of the core particles by the agency of Van der Waals force and electrostatic force and fixing the applied coloring agnet on the core particles by the force of thermal or mechanical impact, by applying and fixing the coloring agent and minute particles of the thermoplastic resin applying and fixig minute particles of the synthetic resin containing the coloring agent, or by carrying out the same procedure using a dye as a coloring agent.

In the electrostatic latent image developing toner of the present invention, the spherical core particles comprising at least a coloring agent and a thermoplastic resin can be obtained by any of the various methdos described above. These core particles are desired to possess an average particle diameter of no more than 14 microns, preferably in the range of 2 to 10 microns. If the core particles have an average particle diameter of less than 2 microns, they have difficulty in retaining the coloring agent in an amount necessary for a desired image density and the toner particles finally obtained acquire an unduly small particle diameter. Thus, there ensues a possibility that coalescence of toner particles or insufficiency or unevenness of charging entails drawbacks such as drifting of the toner, fogging of the produced toner image, insufficient fixation of the image, and inferior heat resistance of the toner. Conversely, if the average particle diameter of the core particles is no less than 14 microns, the finally produced toner particles acquire an unduly large diameter and, therefore, have a possibility that the object of producing images of high accuracy and high quality is not accomplished.

In the electrostatic latent image developing toner of the present invention, the thermoplastic resin to form the core particles thereof is not specifically defined. A vinylic type resin, a polyester type resin, or a thermoplastic epoxy resin can be used as the material for the core particles. Homopolymers and copolymers of various vinylic monomers to be described hereinbelow are preferred examples of the material for the core particles. The physical properties of the thermoplastic resin to form the core particles are not specifically defined. For the finally produced toner to acquire highly satisfactory fixing property and developing property, however, the thermoplastic resin is desired to possess a glass transition point (Tg) not exceeding 70° C., preferably falling in the range of 30° to 60° C., and a softening point not exceeding 180° C., preferably falling in the range of 70° to 150° C.

The vinylic monomers which form thermoplastic resins which answer the description just given inlucde various styrenes such as styrene, o-methyl styrene, m-methyl styrene, p-methyl styrene, p-ethyl styrene, 2,4-dimethyl styrene, p-n-butyl styrene, p-tert-butyl styrene, p-n-hexyl styrene, p-n-octyl styrene, p-n-nonyl styrene, p-n-decyl styrene, p-n-dodecyl styrene, p-methoxy styrene, p-phenyl styrene, p-chlorostyrene, and 3,4-dichlorostyrene, and derivatives thereof, for example. In all the thermoplastic resins cited above, styrene proves to be most desirable. The other vinylic monomer include ethylenically unsaturated monoolefins such as ethylene, propylene, butylene, and isobutylene; vinyl halides such as vinyl chloride, vinylidene chloride, vinyl bromide, and vinyl fluoride; vinyl esters such as vinyl acetate, vinyl propionate, vinyl benzoate, and vinyl butyrate; alpha-methylene aliphatic monocarboxylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, phenyl acrylate, methyl alpha-chloroacrylate, methyl methacrylate, ethyl methacrylate, propyl methacrylate, n-butyl methacrylate isobutyl methacrylate, isopropyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; (meth)acryllic acid derivatives such as acrylonitrile, methacrylonitrile, and acrylamide; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinyl pyrrole, N-vinyl carbazole, N-vinyl indole, and N-vinyl pyrrolidone; and vinyl naphthalene, for example.

As the polymerization initiator to be used in producing desired resin particles by polymerizing a polymerizable monomer mentioned above, any of the conventional polymerization initiators, particularly an oil-soluble polymerization initiator, can be used in an ordinary temperature range. Typical examples of the polymerization initiator are azo compounds such as 2,2'-azobisisobutylonitirle, 2,2'-azobis-2,4-dimethyl valeronitrile, and 2,2'-azobis-4-methoxy-2,4-dimethyl valeronitrile; and peroxides such as acetyl cyclohexyl sulfonyl peroxide, diisopropyl peroxy dicarbonate, decanonyl peroxide, lauroyl peroxide, stearoyl peroxide, acetyl peroxide, t-butylperoxy-2-ethyl hexanoate, benzoyl peroxide, t-butylperoxy isobutyrate, cyclohexanone peroxide, methylethyl ketone peroxide, dicumyl peroxide, t-butyl hydroperoxide, di-t-butyl peroxide, and cumene hydroperoxide. The amount of the polymerization initiator to be used is in the range of 0.01 to 10 parts by weight, preferably 0.5 to 5 parts by weight, based on 100 parts by weight of the monomer. If this amount is less than 0.01 part by weight, the speed of polymerization is low. Conversely, if this amount exceeds 10 parts by weight, the control of the polymerization is difficult.

As the coloring agnet to be contained in the core particles in the electrostatic latent image developing toner of this invention, any of various organic and inorganic pigments and dyes of varying colors can be used.

The black pigments include carbon black, copper oxide, manganese dioxide, aniline black, and activated carbon, for example.

The yellow pigments include chrome yellow, zinc yellow, cadmium yellow, yellow iron oxide, mineral fast yellow, nickel titanium yellow, navel's yellow, naphthol yellow S, Hanza Yellow G, Hansa yellow 10G, benzidine yellow G, benzidine yellow GR, quinoline yellow lake, permanent yellow NCG, and Tartrazine lake, for example.

The orange pigments include red chrome yellow, molybdenum orange, permanent orange GTR, pyrazolone orange, vulcan orange, Indanthrene brilliant orange RK, benzidine orange G, and Indanthrene brilliant orange RK, benzidine oragne G, and Indanthrene brilliant orange GK, for example.

The red pigments include iron oxide red, cadimum red, minium, mercury sulfide, cadmium, permanent red 4R, resol red, pyrazolone red, watching red, calcium salt, lake red D, brilliant carmine 6B, eosin lake, rhodamine lake B, alizarin lake, and brilliant carmine 3B, for example.

The purple pigments include manganese purple, fast violet B, and methyl violet lake, for example.

The blue pigments include iron blue, cobalt blue, alkali blue lake, victoria blue lake, phthalocyanine blue, nonmetallic phthalocyanine blue, partially chlorinated phthalocyanine blue, fast sky blue, and Indanthrene blue BC, for example.

The green pigments include chrome green, chromium oxide, pigment green B, malachite green lake, and final yellow green G, for example.

The white pigments include zinc white, titanium dioxide, antimony white, and zinc sulfide, for example.

The body pigments include baryta powder, barium carbonate, clay, silica, white carbon, talc, and alumina white, for example.

The basic, acid, disperse, and direct dyes inlcude nigrosin, methylene blue, rose bengal, quinoline yellow, and ultramarine blue, for example.

These coloring agents can be used either singly or jointly in the form of a mixture of two or more members. The amount of the coloring agent to be used is desired to be in the range of 1 to 20 parts by weight, preferably 2 to 10 parts by weight, based on 100 parts by weight of the thermoplastic resin contained in the core particles and the thermoplastic resin contained in the outer shell layer. If this amount is more than 20 parts by weight, the produced toner is deficient in the fixing property thereof. Conversely, if the amount is less than 1 part by weight, the possibililty arises that the produced toner fails to form an image of desired density.

The core particles constructed as described above are coated with an outer shell layer containing at least a thermoplastic resin. The outer shell layer to be used in the form of film in the electrostatic latent image developing toner of the present invention is obtained by thermally fixing on the surface of the aforementioned core particles minute particles of the first thermoplastic resin and minute particles of the second thermopastic resin satisfying the following conditional formulas I to IV.

$$-0.2 \leqq R \leqq 0.6 \quad \text{(I)}$$

$$-15 \leqq Tm \leqq 100 \quad \text{(II)}$$

$$-4 \leqq \Delta gel60 \quad \text{(III)}$$

$$|100R + \Delta Tm + 4\Delta gel| \geqq 20 \quad \text{(IV)}$$

providing that in the expressions.

$$R = (R_2 - R_1)/(R_2 + R_1)$$

$$\Delta Tm = Tm_2 - Tm_1$$

$$\Delta gel = gel_2 - gel_1$$

$R_1$ and $R_2$ are average particles diameters (micron) respectively of the minute particles of the first thermoplastic reisn and the minute particles of the second thermoplastic resin, $Tm_1$ and $Tm_2$ are the softening point (°C.) respectively of the minute particles of the second thermoplastic resin, and $gel_1$ and $gel_2$ are amounts of gel formed (% by weight) respectively of the minute particles of the first thermoplastic resin and the minute particles of the second thermoplastic resin.

When the outer shell layer is produced in the form of film by thermally fixing the minute particles of the first thermoplastic resin and those of the second thermoplastic resin possessing mutually different properties on the surface of the core particles under suitable conditions, the difference in fusibility between the minute particles of the two thermoplastic resins enables the produced outer shell layer to retain part of the minute particles of the second thermoplastic resin possessing inferior fusibility in the original particulate form and acquire a surface abounding with very minute irregularities.

To describe this operation more specifically, when there exists a significant difference in average diameter between the minute particles of the first thermoplastic resin and those of the second thermoplastic resin, the minute particles of the first thermoplastic resin which have a smaller diameter are melted faster because of their smaller thermal capacity. Owing to this differnce in speed of fusion, the outer shell layer is produced in the form of film covering the core particles, with the minute particles of the second thermoplastic resin retained partly in the original particulate form and those of the first thermoplastic resin fused thoroughly. As specifically described hereinbelow, in the electrostatic latent image developing toner of this invention, the very minute particles of the first and second thermoplastic resins are deposited fast by the agency of Van der Waals force and electrostatic force on the surface of the core particles and the deposited minute particles are subsequently fused thermally to form a film attached fast to the core particles. The average diameter of the very minute particles of the first thermoplastic resin is desired to be in the range of 0.05 to 3 microns and that of the very minute particles of the second thermoplastic resin in the range of 0.4 to 3 microns, both no less than 1/100 and no more than 1/5 of the average diameter of the core particles. Generally, a powder whose component particles have an average diameter of no more than 0.05 micron is difficult to produce. If the minute particles of the second thermoplastic resin have an average particle diameter of no more than 0.4 micron, the irregularities formed on the toner surface are too small for the present invention to manifest its effect sufficiently. If this average diameter is not less than 3 microns, the coating of the surface of the core particles with the film mentioned above is not easily obtained. If this average diameter is less than 1/100 of the average diameter of the core particles, the outer shell layer produced in the form of film has a too small thickness to possess sufficient strength. If the average diameter exceeds 1/5 of the average diameter of the core particles, the uniform deposition of the minute particles on the surface of the core particles by the agency of Van der Waals force and electrostatic force is not obtained easily.

When there is a significant difference in softening point (Tm) between the minute particles of the first thermoplastic resin and those of the second thermoplastic resin, the minute particles of the first thermoplastic resin of a smaller softening point are fused faster. Owing to this difference in the speed of fusion, the minute particles of the second thermoplastic resin are retained in the original partculate form and those of the first thermoplastic resin are are fused so as to give rise to the outer shell layer in the form of film covering the core particles. In the electrostatic latent image developing toner of the present invention, the outer shell layer to be produced in the form of film covering the core particles is destined to discharge the functions of softening itself in concert with the core particles during the course of fixation thereby enabling the produced toner to manifest the fixing property and the developing property sufficiently and, at the same time, imparting to the toner particles an outstanding ability to resist heat and environmental conditions. The minute particles of the first thermoplastic resin and those of the second thermoplastic resin are each required to possess a glass transition point (Tg) in the range of 50° to 180° C. and a softening point (Tm) in the range of 70° to 200° C.

When there exists a significant difference in the content of gelling component between the minute particles of the first thermoplastic resin and those of the second thermoplastic resin, the minute particles of the second thermoplastic resin which have a larger content of gelling component are less susceptible to the impact force and heat and the minute particles of the first thermoplastic resin having a smaller content of gelling component are fused faster. Owing to this difference in the speed of fusion, the minute particles of the second thermoplastic resin are retained in the original particulate form and those of the first thermoplastic resin are fused so as to give rise to the outer shell layer produced in the form of film covering the core particles. For the outer shell layer to provide a uniform coating for the core particles, the content of gelling component in the minute particles of the first thermoplastic resin first thermoplastic resin is generally desired to be less than 30%.

The differences in the properties, i.e. average diameter, softening point, and content of gelling component mentioned above, between the minute particles of the first thermoplastic resin and those of the second thermoplastic resin should be considered collectively and not independently of each other. If their properties deviate from any of these conditional formulas, the desired surface irregularities cannot be stably imparted to the produced outer shell layer.

The production of the outer shell layer in the form of film covering the outer surface of the core particles in the manner described above is accomplished by mechanically mixing core particles with minute resin particles of a small diameter relative to the core particles (i.e. the minute particles of the first thermoplastic resin and those of the second thermoplastic resin) in a suitable ratio, causing the minute resin particles to be deposited on the peripheral surface of the core particles by the agency of Van der Waals force and electrostatic force, and subsequently fusing the minute resin particles by application of heat thereby converting them into a film by suitable means. The devices usable for heating and fixing the minute resin particles deposited on the surface of the core particles include Spiraflow (produced by Freund Ind., Co., Ltd.), spray driers of ordinary grade, combination heat-treating and impact type modifying machines such as Nara Hybridization System (produced by Nara Machinery Co., Ltd.), Angmill (produced by Hosokawa Micron Corp.), and Mechanomill (produced by Okada Seiko K.K.), for example, besides autoclaves furnished with a stirrer. The fixation of the deposited minute resin particles in the form of film by means of fusion may be carried out in the presence of an inert gas such as nitrogen. In the various devices for the fixation of the outer shell layer in the form of film mentioned above, the combination heat-treating and impact type modifying machine which effects the film formation by softening the minute resin particles owing to the local elevation of temperature as with the mecahnical impact force proves to be particularly advantageous. In accordance with this method, the outer shell layer can be easily produced in the form of film covering the outer surface of the core particles even when the synthetic resin contained in the outer shell layer has a higher softening point than the synthetic resin contained in the core particles. The method described above is not exclusively usable for the formation of the outer shell layer.

The thermoplastic resins to form the minute particles of the first thermoplastic resin and those of the second thermoplastic resin which go to compose the outer shell layer produced in the form of film as described above have no specific restriction except for the sole requirement that they should possess properties expected of the minute particles mentioned above. Vinylic resins, polyester type resins, and thermoplastic type epoxy resins, for example, are usable as such thermoplastic resins. Particularly, various vinylic resins formed of homopolymers or copolymers of the vinylic monomers mentioned above are desirably used. Optionally, these thermoplastic resins may incorporate therein a gelling component such as a partially cross-linked polymer.

The thermoplastic resin under discussion may be produced by any of the conventional methods of polymerization such as, for example, bulk polymerization, suspension polymerization, emulsion polymerization, and solution polymerization. The method to be employed for the formation of the minute particles of the thermoplastic resin is not specifically restricted. Various well-known methods of wet pelletization such as, for example, the comminution method which obtains minute particles of resin by comminuting a mass of resin obtained by a varying method of polymerization and classifying the resultant powder, the pellet polymerization method which obtains minute particles by subjecting the monomer of the kind mentioned above to emulsion polymerization, suspension polymerization, seed polymerization, or soap-free polymerization, the suspension method which pelletizes a vinylic resin by melting the resin and suspending the molten resin in a non-solvent type medium, and the spray drying method which pelletizes a vinylic resin by melting the resin in a solvent and then spray drying the resultant solution are usable for the formation of the minute particles of the thermoplastic resin. The minute particles of the first thermoplastic resin and those of the second thermoplastic resin may be produced by using thermoplastic resins of the type described above and treating them by a method of the type also described above as demonstrated in working examples to be cited hereinbelow. Otherwise, commercially available minute particles of thermoplastic resins cited below by way of example may be used as the minute particles of the first thermoplastic resin and those of second thermoplastic resin on the condition that they should satisfy the requirements imposed thereon. The commercially available minute particles of thermoplastic resin include MP-1000 [polymethyl methacrylate (PMMA) having an average particle diameter of 0.4 micron], MP-1100 (PMMA having an average particle diameter of 0.4 micron), MP1201 (PMMA) having an average particle diameter of 0.4 micron), MP-1400 (PMMA having an average particle diameter of 1 to 2 microns), MP-1401 (PMMA having an average particle diameter of 0.8 micron), MP-1450 (PMMA having an average particle diameter of 0.25 micron), MP1451 (PMMA having an average particle diameter of 0.15 micron), MP-1220 (PMMA having an average particle diameter of 0.4 micron), MP-2701 (PMMA having an average particle diameter of 0.4 micron), MP-3000 (polymethyl methacrylate-divinyl benzene having an average particle diameter of 0.4 micron), MP-4000 (polymethyl methacrylate-butyl methacrylate having an average particle diameter of 0.4 micron), and MP-5000 (polymethyl methacrylate having an average particle diameter of 0.4 micron) (invariably produced by Soken Kagaku K.K.), for example.

In the electrostatic latent image developing toner of the present invention, the outer shell layer produced in the form of film covering the core particles is obtained by thermally fixing the minute particles of the first thermoplastic resin and those of the second thermoplastic resin described above. The amount of the minute particles of the first thermoplastic resin and those of the second thermoplastic resin to be added is in the range of 8 to 50 parts by weight, preferably 10 to 30 parts by weight, based on 100 parts by weight of the core particles. If this amount of addition is less than 8 parts by weight, it is difficult to form the outer shell layer enough to cover the periphery of the core particles completely. Conversely, if this amount exceeds 50 parts by weight, it is difficult to form the outer shell layer enough to cover the core particles uniformly. The amount of the minute particles of the second thermoplastic resin is generally in the range of 5 to 100 parts by weight based on 100 parts by weight of the minute particles of the first thermoplastic resin, though it is variable with the physical properties of the minute particles of the first thermoplastic resin and those of the second thermoplastic resin. If the amount of the minute particles of the second thermoplastic resin to be added deviates from this range, the possibility arises that the desired impartation of irregularities to the surface of the outer shell layer is not obtained.

Further in the electrostatic latent image developing toner of the present invention, the outer shell layer may incorporate therein an electric charge regulating agent when necessary. The electric charge regulating agent may be incorporated as mixed with the thermoplastic resin in the outer shell layer, in the surface region of the outer shell layer or in both the parts mentioned.

The electirc charge regulating agent to be incorporated as occasion demands in the outer shell layer has no specific restriction except for the requirement that it should be capable of triboelectrically imparting a positive or negative electric charge. Various organic and inorganic substances are available as electric charge regulating agents.

The positive electric charge regulating agents include Nigrosin Base EX (produced by Orient Chemical Industries, Ltd.), Quaternary Ammonium Salt P-51 (produced by Orient Chemical Industries, Ltd.), Nigrosin Bontron N-01 (produced by Orient Chemical Industries, Ltd.), Sudan Schwaltz BB (Solvent Black 3: Color Index 26150), Fett Schwaltz HBN (C.I. No. 26150), and Brilliant Spirit Schwaltz TN (invariably produced by Farbenfabriken Bayer AG), Zabon Schwaltz X (produced by Farwerke Hoechst AG), and alkoxylated amines, alkyl amides, and molybdic acid chelate pigment, for example. The negative electric charge regulating agents includ Oil Black (Color Index 26150) and Oil Black BY (produced by Orient Chemical Industries, Ltd.), Bontron S-22 (produced by Orient Chemical Industries, Ltd.), Metal Complex of Salicylic Acid E-81 (produced by Orient Chemical Industries, Co., Ltd.), thioindigo type pigments, sulfonyl amine derivatives of copper phthalocyanine, Spiron Black TRH (produced by Hodogaya Chemical Co., Ltd.), Bontron S-34 (produced by Orient Chemical Industries Co., Ltd.), Nigrosin SO (produced by Orient Chemical Industries, Ltd.), Seleschwaltz (R)G (produced by Farbenfabriken Bayer AG), and Chromogen Black ET-00 (C.I. 14645) and Azo Oil Black (R) (produced by National Aniline Co., Ltd.), for example.

These electric charge regulating agents can be used either singly or jointly in the form of a mixture of two or more members. The amount of the electric charge regulating agent to be incorporated is in the range of 0.001 to 10 parts by weight, preferably 0.001 to 5 parts by weight, based on 100 parts by weight of the thermoplastic resin forming the outer shell layer.

Thus, the electrostatic latent image developing toner of the present invention possesses the outer shell layer produced in the form of film by thermally fixing the minute particles of the first thermoplastic resin and those of the second thermoplastic resin satisfying the conditional formulas I to IV so as to cover the spherical core particles composed of at least a coloring agent and a thermoplastic resin. For the produced toner to be capable of producing an image of high delineation and high quality, the final particle diameter is no more than 14 microns, more desirably no more than 12 microns, and most desirably no more than 10 microns.

Also in the electrostatic latent image developing toner which is disclosed in this specification as another embodiment of this invention, the core particles which are constructed as described above are coated with the outer shell layer containing at least the thermoplastic resin. The outer shell layer so coating the core particles is formed by thermally fixing minute particles of thermoplastic resin and minute particles of a thermosetting resin or minute particles of a resin having a content of gelling component (gel) in the range of $60<gel<100$ on the surface of the aforementioned core particles.

When the minute particles of the thermoplastic resin and the minute particles of the thermosetting resin or the minute particles of the resin having the content of gelling component (gel) in the range of $60<gel<100$ are thermally fixed on the surface of the core particles as described above, since the minute particles of the thermoplastic resin are completely fused and the minute particles of the thermosetting resin or the minute particles of the resin having the content of gelling component (gel) in the range of $60<gel<100$ are not fused, the produed outer shell layer has the minute particles of the thermosetting resin or the minute particles of the resin having the content of gelling component (gel) in the range of $60<gel<100$ retained in their original particulate form in a matrix produced in the form of film by the fusion of the thermoplastic resin, with minute irregularities imparted to the surface thereof. Though the outer shell layer partly contains the minute particles of the thermosetting resin or the minute particles of the resin having the content of gelling component (gel) in the range of $60<gel<100$ as described above, the amount of these minute particles of the thermosetting resin or the minute particles of the resin having the content of gelling component (gel) in the range of $60<gel<100$ is extremely small as compared with the total amount of the toner particles. These minute particles, therefore, bring about virtually no decline of the fixing property of the toner particles. On the contrary, the addition of these minute particles of the thermosetting resin or the minute particles of the resin haivng the content of gelling component (gel) in the range of $60<gel<100$ diminishes the dependency of the melt viscosity of the toner particles on temperature and enhances the high temperature offsetting property. Optionally, the minute particles of the thermosetting resin and the minute particles of the resin having the content of gelling component (gel) in the range of $60<gel<100$ may be jointly used in the form of a mixture.

The production of the outer shell layer which has the minute particles of the thermosetting resin or the minute particles of the resin having the content of gelling component (gel) in the range of $60<gel<100$ retained in their original particulate form in the matrix of the thermoplastic resin may be attained, similarly to the first embodiment of the invention, by mechanically mixing the core particles and the minute particles of the thermosetting resin or the minute particles of the resin having the content of gelling component (gel) in the range of $60<gel<100$ in a suitable ratio, allowing the minute particles to adhere uniformly to the periphery of the core particles by the agency of Van der Waals force and electrostatic force, and heating the resultant composite by suitable means so as to melt the minute particles of the thermoplastic resin in the form of film. The production may be accomplished otherwise by having the minute particles of the thermoplastic resin and the minute particles of the thermosetting resin or the minute particles of the resin having the content of gelling component (gel) in the range of $60<gel<100$ separately attached and fixed instead of having them simultaneously fixed by heating. In this case, the outer shell layer is obtained by first mechanically mixing the core particles and the minute particles of the thermoplastic resin in a suitable ratio, allowing only the minute particles of the thermoplastic resin to adhere to the periphery of the core particles by the agency of Van der Waals force and electrostatic force, thermally fusing and fixing the adhering minute particles in the form of film, then allowing the minute particles of the thermosetting resin or the minute particles of the resin having the content of gelling component (gel) in the range of $60<gel<100$ to adhere to the core particles now possessing the coating layer of the thermoplastic resin by the agency of Van der Waals force and electrostatic force, and fixing the adhering minute particles on the coating layer of the thermoplastic resin as by the mechanical impact force.

For the thermal fixation of the minute particles of the resin adhering to the surface of the core particles, any of the devices cited previously may be used. The devices usable advantageously for the fixation of the minute particles of the thermosetting resin or the minute particles of the resin having the content of gelling component (gel) in the range of $60<gel<100$ on the coating layer of the thermoplastic resin include the aforementioned combination heat-treating and impact type modifying machines [such as Nara hybridization system (produced by Nara Machinery Co., Ltd.), Angmill (produced by Hosokawa Micron Corp.), and Mechanomill (produced by Okada Seiko K.K.p)].

The minute particles of the thermoplastic resin to form the outer shell layer as described above may be selected from those made of various kinds of thermoplastic resins similarly to the minute particles of the first thermoplastic resin and those of the second thermoplastic resin used in the first embodiment of this invention described above. The method for the formation of the minute particles from such thermoplastic resins may be freely selected from among the various well-known methods described above. The physical properties of the thermoplastic resin of which the minute particles are made are not specifically restricted. The outer shell layer which is formed of the minute particles of the thermoplastic resin in the form of film covering the core particles as described above is required to soften itself in concert with the core particles during the course of fixing and manifest the fixing property and the developing property sufficiently and, at the same time, function to impart to the toner particles the ability to resist heat and environmental conditions. Thus, the thermoplastic resin is desired to possess a glass transition point (Tg) in the range of 50° to 180° C. and a softening point (Tm)in the range of 70° to 200° C.

The minute particles of the thermosetting resin, one of the components forming the outer shell layer of the description given above are made of any of various well-known thermosetting resins such as, for example, thermosetting epoxy resin, phenol resin, furan resin, xylene-formaldehyde resin, ketone-formaldehyde resin, urea resin, melamine resin, aniline resin, alkyd resin, unsaturated polyester resins, thermosetting urethane resin, triazine type resins such as benzoguanamine resin, triallyl cyanurate resin, acrolein type resins, and silicone resin. For the formation of the minute particles of the thermosetting resin, there can be employed any of the conventional methods such as, for example, the method which obtains minute particles by comminuting a mass of resin resulting from curing reaction and, in the case of a thermosetting resin capable of being cured with heat, the method which obtains minute particles by preparing pellets containing a curing component and subsequently hardening the pellets.

The various commercially available thermosetting resin particles cited below as examples are usable as the minute particles of thermosetting resin contemplated herein. The commercially available thermosetting resin particles include melamine resin particles having an average diameter of 0.3 micron (produced by Nippon Shokubai Kagaku Kogyo Co., Ltd. and marketed under trademark designation of "Eposter S"), benzoguanamine resin particles having an average diameter of 2 microns (produced by Nippon Shokubai Kagaku Kogyo Co., Ltd. and marketed under trademark designation of "Eposter MS"), and silicone resin particles having an average diameter of 2 microns (produced by Toshiba Silicone K.K. and marketed under product code of "XC 99-501").

As the resin having the content of a gelling component (gel) in the range of $60<gel<100$, what is obtained by suitably selecting a cross-linking agent to be contained in a thermosetting resin of the type usable in the aforementioned core particles thereby allowing the thermosetting resin to possess a gelling component in a desired concentration can be used.

Since the minute particles of the thermosetting resin or the minute particles of the resin having the content of gelling component (gel) in the range of $60<gel<100$ attached fast to the surface of the core particles by the agency of Van der Waals force and electrostatic force and then fixed, they are required to have an average diameter of no less than 1/100 and no more than 1/5 of the average diameter of the core particles. Further, the minute particles of the thermoplastic resin are desired to possess an average diameter in the range of 0.05 to 3 microns and those of the thermosetting resin and those of the resin having the content of gelling component (gel) in the range of $60<gel<100$ each to possess an average diameter in the range of 0.4 to 3 microns. A powder whose component particles have an average diameter of less than 0.05 micron is difficult to produce. If the minute particles of the thermosetting resin or the minute particles of the resin having the content of gelling component (gel) in the range of $60<gel<100$ have an average diameter of less than 0.4 micron, the impartation of sufficient irregularities to the surface of the toner particles is not attained. If this average diameter is larger than 3 microns, the formation of the coating layer on the surface of the core particles is attained ouly with difficulty. If the minute particles mentioned above have an average diameter of less than 1/100 of the average diameter of the core particles, the outer shell layer produced in the form of film has a too small thickness to acquire sufficient strength. If this average diameter exceeds 1/5 of the average diameter of the core particles, the uniform fast attachment of the aforementioned minute particles to the surface of the aforementioned minute particles to the surface of the core particles by the agency of Van der Waals force and electrostatic force is attained only with difficulty.

In the electrostatic latent image developing toner as the second embodiment of this invention, the outer shell layer produced in the form of film covering the core particles is obtained by thermally fixing the minute particles of the thermoplastic resin and the minute particles of the thermosetting resin or the minute particles of the resin having the content of gelling component (gel) in the range of $60<gel<100$. The amount of the minute particles of the thermoplastic resin to be added is in the range of 8 to 30 parts by weight, based on 100 parts by weight of the core particles. If this amount of addition is less then 8 parts by weight, the formation of the outer shell layer in the form of film completely covering the core particles is attained only with difficulty. Conversely, if this amount exceeds 30 parts by weight, the formation of the outer shell layer in the form of film uniformly covering the core particles is attained with difficulty. The amount of the minute particles of the thermosetting resin or the minute particles of the resin having the content of gelling component (gel) in the range of $60gel<100$ to be added is in the range of 5 to 100 parts by weight, based on 100 parts by weight of the minute particles of the thermoplastic resin. If the amount of the minute particles of the thermosetting resin or the minute particles of the resin having the content of gelling component (gel) in the range of $60<gel<100$ to be added is less than 5 parts by weight, the possibility arises that the impartation of sufficient irregularities to the surface of the outer shell layer is not attained. Conversely, if this amount exceeds 100 parts by weight, the possibility ensues that the stable retention of the minute particles of the thermosetting resin or the minute particles of the resin having the content of gelling component (gel) in the range of $60<gel<100$ in the matrix of the thermoplastic resin produces in the form of film is attained only with difficulty.

Further in the electrostatic latent image developing toner of the second embodiment of this invention, similarly to the electrostatic latent image developing toner of the first embodiment of this invention, the outer shell layer, when necessary, may incorporate therein any of the various electric charge regulating agents cited above.

As described above, the electrostatic latent image developing toner of the second embodiment possesses the outer shell layer produced by thermally fixing the minute particles of the thermosetting resin or the minute particles of the resin having the content of gelling component (gel) in the range of $60<gel<100$ in the form of film covering the spherical core particles composed of at least a coloring agent and a thermoplastic resin. For the produced toner to be capable of producing an image of high delineation and high quality, the final average diameter of the aforementioned minute particles is required to be no more than 14 microns, more desirably no more than 12 microns, and most desirably no more than 10 microns.

From a different point of view, when the outer shell layer to be produced in the form of film covering the surface of the spherical core particles composed of at least a thermoplastic resin and a coloring agent is obtained by thermally fixing the minute particles of the first thermoplastic resin and those of the second thermoplastic resin satisfying the conditional formulas I to IV mentioned above or by thermally fixing the minute particles of the thermoplastic resin and the minute particles of the thermosetting resin or the minute particles of the resin having the content of gelling component (gel) in the range of $60<gel<100$, the toner particles to be obtained acquire a spherical shape substantially similar to that of the core particles, specifically a spherical shape of a shape coefficient, SF1, of no more than 150, preferably no more than 140 and possess minute irregularities in the surface thereof.

When the toner particles have a shape coefficient, SF1, of no more than 150 and possess minute irregularities in the surface thereof, they enjoy very satisfactory flowability, defy such drawbacks as decline of charging property and deterioration of cleaning property, and permit production of an image of high delineation and high quality, even when they are fromed in an average diameter of no more than 14 microns, more desirably no more than 12 microns, and most desirably no more than 10 microns.

The various terms as used in the present specification have meanings defined below or represent magnitudes determined by procedures described below.

The term "content of gelling component" means the resin component of a given sample which is not dissolved in toluene. The numerical values of this content indicated in the specification have been obtained by the following method of determination. This method comprises subjecting a given thermoplastic resin sample (Ms) [g] to extraction with a Soxhlet extractor using a glass fiber (G-3) thereby denuding the resin sample of a toluene-soluble component, drying the insoluble residue (Mr) of the resin sample and weighing the dried residue, and reporting the weight percent of the insoluble residue as the content of gelling component of the sample.

$$\text{Content of gelling component} = (Mr/Ms) \times 100$$

The property "softening point (Tm)" has been determined by the dry-bulb type method.

The property "glass transition point (Tg)" has been determined by use of a DSC made by Seiko Denshi K.K.

The average particle diameter represents the numerical value obtained by measuring the relative weight distribution classified by particle diameter with a Call Counter II (produced by Call Counter Corp.) using an aperture tube 100 microns in diameter.

The shape coefficient, SF1, generally represents the sphericity of a sample powder to be used as the parameter denoting the difference between the major diameter and the minor diameter of particle. This is defined by the following formula. The numerical values of the shape coefficient indicated in the present specification have been found with an image analyzer (produced by Nihon Regulator K.K. and marketed under trademark designation of "Luzex 5000"). This statement does not necessarily mean that the determination should be performed with the particular machine mentioned above because the determination generally allows for no appreciable difference due to variation in type of machine.

$$SF1 = \frac{(\text{Maximum length})^2}{\text{Area}} \times \frac{\pi}{4} \times 100$$

wherein the "area" represents the average of projected areas of particles of a sample powder and the "maximum length" represents the average of maximum lengths in the projected images of particles of the sample powder.

Thus, the numerical value of the shape coefficient, SF1, approximates to 100 in proportion as the shape of a given toner powder approaches true sphericity.

Now, this invention will be described more specifically below with reference to working examples.

EXAMPLE 1 OF CORE PARTICLES PRODUCTION

In a polymerization reactor provided with a stirrer, a condenser, and a thermometer, 70 parts by weight of monomeric styrene, 25 parts by weight of n-butyl methacrylate, 5 parts by weight of stearyl methacrylate, and 1 part by weigth of 2,2'- azobis(2,4-dimethyl valeronitrile) as a polymerization initiator were dissolved in 1 liter of deionized water containing 3% of completely saponified polyvinyl alcohol (polymerization degree about 1,000) and 1% of sodium dodecylbenzene sulfonate. With the air of a mixing and dispersing means (produced by Tokushu Kika Kogyo K.K. and marketed under trademark designation of "TK Autohomomixer"), the monomer was gradually added dropwise and heated for polymerization at 80° C. for 6 hours with the revolution number of the turbine increased stepwise from 1,000 rpm onward.

After the polymerization was completed, the polymerization mixture was filtered with a centrifugal dehydrator, washed 7 to 8 times with purified water, and classified to obtain resin particles possessing a number average molecular weight, Mn, of 12,000 a weight average molecular weight, Mw, of 180,000, a glass transition point, Tg, of 58° C., a softening point, Tm, of 125° C., and an average diameter of 8.0 microns.

In a Henschel mixer having an inner volume of 10 liters, 100 parts by weight of the resin particles obtained as described above and 8 parts by weight of carbon black (produced by Mitsubishi Chemical Industries K.K. and marketed under product code of "MA #8") were stirred at a revolution number of 1,600 rpm for 2 minutes to effect deposition of the carbon black on the surface of the resin particles. Then, with Nara Hybridization System NHS-1, the coated resin partciles were treated at a revolution number of 7,000 rpm for 3 minutes, to effect fixation of the carbon black on the surface of the polymer particles and obtain Core Particles I.

EXAMPLE 2 OF CORE PARTICLES PRODUCTION

By treating 100 parts by weight of discrete spherical partiles by styrene-acryl copolymer resin (possessing an average diameter of 6 microns, a glass transition point, Tg, of 55° C., and a softening point, Tm, of 120° C.) obtained by seed polymerization and 10 parts by weight of carbon black (produced by Deggusa and marketed under trademark designation of "Printex 25") were treated in the same manner as in Example 1 of Core Particles Production, to effect fixation of the carbon black to the surface of the discrete spherical particles of styrene-acryl copolymer resin and obtain Core Particles II.

EXAMPLE 3 OF CORE PARTICLES PRODUCTION

By thoroughly mixing 60 parts by weight of styrene, 30 parts by weight of n-butyl methacrylate, 10 parts by weight of 2-ethylhexyl methacrylate, 5 parts by weight of copper phthalocyanine pigment, and 0.5 part by weight of benzoyl peroxide as a polymerization initiator and subjecting the resultant mixture to polymerization in the same manner as in Example 1 of Core Particles Production, Core Particles III were obtained which had the coloring agent possessing an average diameter of 8.2 microns dispersed therein and possessing a number average molecular weight, Mn, of 8,000, a weight average molecular weight, Mw, of 150,000, a glass transition point, Tg, of 53° C., and a softening point, Tm, of 115° C.

EXAMPLE 1 OF THERMOPLASTIC RESIN PARTICLES PRODUCTION

In a polymerization reactor provided with a stirrer, condenser, and a thermometer, 70 parts by weight of methyl methacrylate, 20 parts by weight of n-butyl methacrylate, 10 parts by weight of ethylene glycol dimethacrylate, and 0.05 part by weight of benzoyl peroxide as a polymerization initiator were dissolved in 1 liter of deionized water containing 3% of completely saponified polyvinyl alcohol (polymerization degree about 1,000) and 1% of sodium dodecyl benzene sulfonate. With the aid of a mixing and dispersing means (produced by Tokushu Kika Kogyo K.K. and marketed under trade mark designation of "TK Autohomomixer"), the resultant solution was stirred at 10,000 rpm and heated for polymerization at 80° C., for 5 hours with the revolution number of the turbine increased stepwise from 10,000 rpm onward.

After the polymerization was completed, the polymerization mixture was filtered with a centrifugal dehydrator, washed 7 to 8 times with purified water, dried under a vacuum, and disintegrated and classified, to obtain minute particles a of thermoplastic resin possessing a glass transition point, Tg, of 83° C., a softening point, Tm, of 170° C., a gel component content of 13%, and an average particle diameter of 1.0 micron.

EXAMPLE 2 OF THERMOPLASTIC RESIN PARTICLES PRODUCTION

By repeating the procedure of Example 1 of Thermoplastic Resin particles Production, except that the use of n-butyl methacrylate and ethylene glycol dimethacrylate was omitted. Consequently, minute particles b of thermoplastic resin were obtained which possessed a glass transition point, Tg, of 81° C., a softening point, Tm, of 165° C., a gelling component content of 0%, and an average diameter of 1.0 micron.

EXAMPLE 3 OF THERMOPLASTIC RESIN PARTICLES PRODUCTION

By repeating the procedure of Example 1 of Thermoplastic Resin Particles Production, except that 2 parts by weight of ethylene glycol dimethacrylate and 5 parts by weight of stearyl methacrylate were used in place of 10 parts by weight of ethylene glycol dimethacrylate, minute particles c of thermoplastic resin were obtained which possessed a glass transition point, Tg, of 63° C., a softening point, Tm, of 135° C., a gelling component content of 3%, and an average diameter of 1.0 micron.

EXAMPLE 4 OF THERMOPLASTIC RESIN PARTICLES PRODUCTION

By repeating the procedure of Example 1 of Thermoplastic Resin Particles Production, except that the revolution number of the turbine was changed to 12,000 rpm, minute particles d of thermoplastic resin were obtained which possessed a glass transition point, Tg, of 83° C., a softening point, Tm, of 164° C., a gelling component content of 15%, and an average diameter of 0.6 micron.

EXAMPLE 5 OF THERMOPLASTIC RESIN PARTICLES PRODUCTION

By repeating the procedure of Example 2 of Thermoplastic Resin Particles Production, except that the revolution number of the turbine was changed to 12,000 rpm, minute particles e of thermoplastic resin were obtained which possessed a glass transition point, Tg, of 81° C., a softening point, Tm, of 167° C., a gelling component content of 0%, and an average diameter of 0.7 micron.

EXAMPLE 6 OF THERMOPLASTIC RESIN PARTICLES PRODUCTION

By repeating the procedure of Example 4 of Thermoplastic Resin Particles Production, except that 3 parts by weight of ethylene glycol dimethacrylate and 12 parts by weight of stearyl methacrylate were used in place of 10 parts by weight of ethylene glycol dimethacrylate, minute particles f of thermoplastic resin were obtained which possessed a glass transition point, Tg, of 61° C., a softening point, Tm, of 113° C., a gelling component content of 8%, and an average diameter of 0.7 micron.

EXAMPLE 7 OF THERMOPLASTIC RESIN PARTICLES PRODUCTION

By repeating the procedure of Example 4 of Thermoplastic Resin Particles Production, except that 25 parts by weight of n-butyl methacrylate and 5 parts by weight of stearyl methacrylate were used in place of 20 parts by weight of n-butyl methacrylate and 10 parts by weight of ethylene glycol dimethacrylate, minute particles g of thermoplastic resin were obtained which possessed of a glass transition point, Tg, of 64° C., a softening point, Tm, of 118° C., a gelling component content of 0%, and an average diameter of 0.6 micron.

EXAMPLE 8 OF THERMOPLASTIC RESIN PARTICLES PRODUCTION

By repeating the procedure of Example 4 of Thermoplastic Resin Particles Production, except that 35 parts by weight of trimethylol propane trimethacrylate was used in place of 10 parts by weight of ethylene glycol dimethacrylate, minute particlees h of thermoplastic resin were obtained which possessed a glass transition point, Tg, of 90° C., a softening point, Tm, of 180° C., a gelling component content of 84%, and an average diameter of 0.6 micron.

The properties of the minute particles a to h of thermoplastic resin obtained as described above are shown collectively in Table 1.

TABLE 1

| Symbol of resin particles | Particle diameter (μm) | Softening point (°C.) | Gelling component content (%) |
|---|---|---|---|
| a | 1.0 | 170 | 13 |
| b | 1.0 | 165 | 0 |
| c | 1.0 | 134 | 3 |
| d | 0.6 | 164 | 15 |
| e | 0.7 | 167 | 0 |
| f | 0.7 | 113 | 8 |
| g | 0.6 | 118 | 0 |
| h | 0.6 | 180 | 84 |

EXAMPLE OF CARRIER PRODUCTION

The carrier which was mixed with the toner particles produced in the working examples cited hereinbelow for the formation of developing agents was a binder type carrier, which was obtained as follows.

| Component | Parts by weight |
|---|---|
| Magnetite (produced by Titan Kogyo K. K. and marketed under product code of "BL-SP") | 200 |
| Styrene-acryl copolymer resin (produced by Goodyear tire & rubber Company and marketed under trademark designation of "Briorite ACL") | 100 |
| Silica (produced by Nippon Aerosil and marketed under trademark designation of "Silica #200") | 2 |

These components were thoroughly mixed in a supermixer and kneaded in a single-screw extrusion kneader. The resultant mixture was cooled, ground coarsely, and comminuted into particles having an average diameter of 35 microns in a hammer mill. The particles were classified with a wind classifier into coarse particles and minute particles to obtain a carrier A composed of particles having an average diameter of 33 microns. This carrier A was found to possess a specific gravity of 2.4 g/cm$^2$.

EXAMPLE 1

One hundred (100) parts by weight of the Core Particles I obtained in Example 1 of Core Particles Production, 10 parts by weight of the minute particles a of thermoplastic resin obtained in Example 1 of Thermoplastic Resin Particles Production, and 3 parts by weight of the minute particles b of thermoplastic resin obtained in Example 2 of Thermoplastic Resin Particles Production were subjected to the same treatment as used in the formation of the layer of coloring agent on the resin particles in Example 1 of Core Particles Production, to produce a coating layer of resin covering the surface of the Core Particles I and obtain a toner possessing an average particle diameter of 9.8 microns and a shape coefficient, SF1, of 138.

When particles of the toner obtained as described above were examined under a scanning electron microscope, they were found to retain their original particulate form in their surface and contain irregularities therein.

The toner and a carrier B (acryl resin-coated ferrite carrier produced by Nihon Teppun K.K. and marketed under product code of "FM-300") were tested for rise of charging amount, image quality, cleaning property, and printability. They showed very satisfactory results as shown in Tables 3 and 4.

EXAMPLES 2 TO 13, 16 AND COMPARATIVE EXAMPLES 1 to 8

Toners of Examples 2 to 13 and 16 and toners of Comparative Examples 1 to 8 indicated in Table 2 were obtained by following the procedure of Example 1 using the core particles and the minute particles of thermoplastic resin indicated in the same table and these toners were similarly tested. As shown in Tables 3 and 4, the toners of Examples 2 to 13 and 16 gave very satisfactory results similarly to those of the toner A of Example 1, whereas the toner of Comparative Example 1 and Comparative Example 3 were found to be deficient in the cleaning property and the image quality, the toner of Comparative Example 2 in the printability, the toner of Comparative Example 4 in the cleaning property, the image quality, and the printability, the toner of Comparative Example 5 in the image quality and the printability, the toner of Comparative Example 6 in all the properties involved in the test, the toner of Comparative Example 7 in the printability, and the toner of Comparative Example 8 in the rise of charging amount and the printability. In the toners of Comparative Examples 1 to 8, the minute particles of the first and second thermoplastic resins forming their outer shell layers were incapable of satisfying any of the aforementioned conditional formulas I to IV.

EXAMPLE 14

The procedure of Example 1 was repeated, except that 2 parts by weight of minute particles of a thermosetting melamine resin having an average diamter of 0.3 micron (produced by Nippon Shokubai Kagaku Kogyo Co., Ltd. and marketed under trademark designation of "Eposter S") were used in place of the minute particles b of thermoplastic resin as minute particles of resin. Consequently, a toner N was obtained which possessed an average particle diameter of 9.4 microns and a shape coefficient, SF1, of 134. When this toner as used in combination with the aforementioned carrier A was similarly tested, it gave highly satisfactory results as shwon in Tables 3 and 4.

COMPARATIVE EXAMPLE 9

The procedure of Example 1 was repeated, except that the use of 2 parts by weight of the minute particles b of thermoplastic resin was omitted. Consequently, a toner possessing an average particle diameter of 9.0 microns and a shape coefficient, SF1, of 126 was obtained. When this toner was tested in the same manner as in Example 1, it was found to be deficient in the rise of charigng amount, the cleaning property, the image quality, and the printability as shwon in Tables 3 and 4.

EXAMPLE 15

One hundred (100) parts by weight of the toner obtained in Comparative Example 9 and 3 parts by weight of minute particles of thermosetting melamine resin having an average diameter of 0.3 micron (produced by Nippon Shokubai Kagaku Kogyo Co., Ltd. and marketed under trademark designation of "Eposter S") were subjected to the smae treatment for fixation as in the formation of the coating layer of minute particles of thermoplastic resin in Comparative Example 9. Consequently, a toner possessing an average particle diameter of 9.3 microns and a shape coefficient, SF1, of 136 was obtained. When this toner used in combination with the carrier A was tested in the same manner as in Example 1, it gave highly satisfactory results as shown in Tables 3 and 4.

EXAMPLE 16

The procedure of Example 1 was repeated, except that the minute particles H of thermoplastic resin were used in place of the minute particles b of thermoplastic resin as minute particles of resin. Consequently, a toner possessing an average particle diameter of 9.6 microns and a shape coefficient, SF1, of 137 was obtained. When this toner was tested in the same manner as in Example 1, it gave highly satisfactory results as shown in Tables 3 and 4.

COMPARATIVE EXAMPLE 10

The core particles III (possessing an average diameter of 8.2 microns and a shape coefficient, SF1, of 119) obtained in Example 3 of Core Particles Production were used in their unmodified form as a toner X. When this toner X was tested in the same manner as in Example 1, it gave results unsatisfactory in all the test items.

The properties of the toners A to X obtained in Examples 1 to 14 and Comparative Examples 1 to 10 as described above are collectively shown in Table 2.

The method employed for testing the toners A to X of Examples 1 to 14 and Comparative Examples 1 to 10 was as follows.

Method of Test for Properties

The samples obtained by aftertreating 100 parts by weight of severally of the toners, A to X, mentioned above each with 0.1 part by weight of colloidal silica (produced by Nihon Aerosil K.K. and marketed under product code of "R-972") were tested for the various properties.

Amount of Charging (Q/W) and Amount of Scattering

The surface-treated toner samples obtained as described above of the toners of Examples 1 to 13 and 16 and Comparative Examples 1 to 10 were placed each in a fixed amount of 2 g in combination with 38 g of the carrier B and those similarly obtained of the toners of Examples 14 and 15 each in a fixed amount of 2 g in combination with 28 g of the carrier A in plastic vials 50 cc in inner volume. The plastic vials containing the samples were mounted on a rotary base and rotated to stir the contents for 3, 10, and 30 minutes to find the rise in the amount of charging and the amount of scattering at the time of the rise mentioned above.

The amount of scattering was determined with a digital dust meter (produced by Shibata Kagaku K.K. and marketed under product code of "P5H2 Model"). This determination was carried out by setting the dust meter and a magnet roll as separated by a distance of 10 cm, placing 2 g of a given developing agent on the magnet roll, rotating the magnet at 2,000 rpm thereby inducing a scattering toner particles from the developing agent, and enabling the dust meter to detect the amount of this scattering and display this amount as the count of cpm per minute. The results of the determination of the amount of charging and the amount of scattering are shown in Table 3.

Evaluation of Imaging

In the case of the toners of Examples 1 to 13 and 16 and Comparative Examples 1 to 10, two-component developing agents were prepared by mixing the toners severally with a carirer in a toner/carrier ratio of 5/95. These developing agents were tested for initial imaging (and for printability) with a copying machine (produced by Minolta Camera K.K. and marketed under product code of "EP-559Z"). In the case of the toners of Examples 14 and 15, two-component developing agents were prepared by mixing the toners severally with a carrier in a toner/carrier ratio of 8/92 and similarly tested with ac copying machine (produced by Minolta Camera Kabushiki Kaisha and marketed under product code of "EP 450 P"). The items of test involved were as shown in Table 4.

(1) Fogging on image

The various toner/carrier combinations mentioned above were tested for imaging with the aforementioned copying machines. As concerns the fogging of a produced image, the extent of fogging of the toner appearing in the iamge produced on a white background was rated on the four-point scale (◎, ○, Δ, and × in the decreasing order of desirability; the Δ rank representing a tolerable level and the rank a desirable level).

(2) Image quality

The images copied from the standard chart available from Data Quest K.K. under suitable conditions were developed with the aforementioned combinations. The developed imags were tested for quality by the following method. The density of the solid part of the image was measured with a Sakura densitometer and rated. The images developed were tested with the standard chart of Data Quest K.K. for graduation, resolution, line reproducibility, and fineness of image texture on the four-point scale (◎, ○, Δ and × in the decreasing order of desirability; the Δ rank representing a tolerable level and the ○ rank a desirable level).

(3) Test for printability.

With the copying machine mentioned above, 100,000 copies were produced from the developed images. At the same time, the copies were tested for amount of charging time, the copies were tested for amount of charging and fogging.

(4) Test for cleaning property

During the course of the test for image quality, the surface of the sensitive material was visually examined to find whetehr the toner remaining after the transfer of a developed image on the copying paper was perfectly removed with a cleaning blade or suffered to remain on the sensitive material after passage of the cleaning blade (namely, inferior cleaning).

TABLE 2

| No. | Core particle | Minute particle (First) | Minute particle Second) | Diamter (μm) | SF1 (%) | Conditional formulas (I) R | (II) ΔTm | (III) Δgel | (IV) 100r + ΔTm + 4 gel | Formula not satisfied |
|---|---|---|---|---|---|---|---|---|---|---|
| Example 1 | I | b | a | 9.8 | 138 | 0.00 | 5 | 13 | 57 | |
| Example 2 | II | c | a | 7.3 | 137 | 0.00 | 36 | 10 | 76 | |
| Example 3 | III | d | a | 9.6 | 135 | 0.25 | 6 | −2 | 23 | |
| Example 4 | I | e | a | 9.7 | 139 | 0.18 | 3 | 13 | 73 | |
| Example 5 | I | f | a | 9.5 | 130 | 0.18 | 57 | 5 | 95 | |
| Example 6 | I | g | a | 9.6 | 138 | 0.25 | 52 | 13 | 129 | |

TABLE 2-continued

| No. | Core particle | Minute particle (First) | Minute particle Second) | Diamter (μm) | SF1 (%) | Conditional formulas (I) R | (II) ΔTm | (III) Δgel | (IV) 100r + ΔTm + 4 gel | Formula not satisfied |
|---|---|---|---|---|---|---|---|---|---|---|
| Example 7 | I | g | b | 9.5 | 133 | 0.25 | 47 | 0 | 72 | |
| Example 8 | I | g | c | 9.5 | 135 | 0.25 | 16 | 3 | 53 | |
| Example 9 | I | e | d | 9.3 | 139 | −0.08 | −3 | 15 | 49 | |
| Example 10 | I | f | d | 9.3 | 142 | −0.08 | 51 | 7 | 71 | |
| Example 11 | I | g | d | 9.2 | 133 | 0.00 | 46 | 15 | 106 | |
| Example 12 | I | g | e | 9.1 | 134 | 0.08 | 49 | 0 | 57 | |
| Example 13 | I | g | f | 9.3 | 138 | 0.08 | −5 | 8 | 35 | |
| Example 14 | I | a | thermo-setting resin | 9.4 | 134 | | — | — | — | |
| Example 15 | I | a | thermo-setting resin | 9.3 | 136 | | — | — | — | |
| Comparative Example 16 | I | a | h | 9.6 | 137 | | — | — | — | |
| Comparative Example 1 | I | b | c | 9.8 | 133 | 0.00 | −31 | 3 | 19 | (II), (IV) |
| Comparative Example 2 | I | b | d | 9.6 | 132 | −0.25 | −1 | 15 | 34 | (I) |
| Comparative Example 3 | I | b | e | 9.6 | 135 | −0.18 | 2 | 0 | 16 | (IV) |
| Comparative Example 4 | I | f | b | 9.7 | 137 | 0.18 | 52 | −8 | 38 | (III) |
| Comparative Example 5 | I | c | d | 9.5 | 131 | −0.25 | 30 | 12 | 53 | (I) |
| Comparative Example 6 | I | c | e | 9.6 | 136 | −0.18 | 33 | −3 | 3 | (III) |
| Comparative Example 7 | I | c | f | 9.7 | 134 | −0.18 | −21 | 5 | 19 | (II), (IV) |
| Comparative Example 8 | I | e | f | 9.4 | 133 | 0.00 | −54 | 8 | 22 | (II) |
| Comparative Example 9 | I | a | — | 9.0 | 126 | — | — | — | — | |
| Comparative Example 10 | III | — | — | 8.2 | 119 | — | — | — | — | |

TABLE 3

| Example or Comparative Example | 3 minutes Q/M | 3 minutes Scattering | 10 minutes Q/M | 10 minutes Scattering | 30 minutes Q/M | 30 minutes Scattering |
|---|---|---|---|---|---|---|
| Example 1 | −13 | ◎ | −14 | ◎ | −14 | ◎ |
| Example 2 | −13 | ◎ | −14 | ◎ | −14 | ◎ |
| Example 3 | −14 | ◎ | −14 | ◎ | −14 | ◎ |
| Example 4 | −15 | ◎ | −15 | ◎ | −15 | ◎ |
| Example 5 | −13 | ◎ | −14 | ◎ | −15 | ◎ |
| Example 6 | −14 | ◎ | −14 | ◎ | −15 | ◎ |
| Example 7 | −12 | ◎ | −14 | ◎ | −14 | ◎ |
| Example 8 | −13 | ◎ | −13 | ◎ | −13 | ◎ |
| Example 9 | −13 | ◎ | −13 | ◎ | −14 | ◎ |
| Example 10 | −14 | ◎ | −14 | ◎ | −15 | ◎ |
| Example 11 | −13 | ◎ | −14 | ◎ | −14 | ◎ |
| Example 12 | −14 | ◎ | −14 | ◎ | −14 | ◎ |
| Example 13 | −12 | ◎ | −13 | ◎ | −13 | ◎ |
| Example 14 | +18 | ◎ | +19 | ◎ | +19 | ◎ |
| Example 15 | +18 | ◎ | +18 | ◎ | +18 | ◎ |
| Example 16 | −13 | ◎ | −14 | ◎ | −14 | ◎ |
| Comparative Example 1 | −8 | Δ | −10 | ○ | −11 | ○ |
| Comparative Example 2 | −11 | ◎ | −12 | ◎ | −12 | ◎ |
| Comparative Example 3 | −7 | Δ | −9 | ○ | −10 | ○ |
| Comparative Example 4 | −6 | Δ | −8 | ○ | −9 | ○ |
| Comparative Example 5 | −8 | ○ | −8 | ○ | −9 | ○ |
| Comparative Example 6 | −4 | X | −5 | X | −6 | X |
| Comparative Example 7 | −7 | Δ | −9 | ○ | −10 | ◎ |
| Comparative Example 8 | −7 | X | −8 | ○ | −9 | ○ |
| Comparative Example 9 | −5 | X | −7 | X | −8 | Δ |
| Comparative Example 10 | −4 | X | −5 | X | −5 | X |

Q/M: Amount of toner charging (micron /g)
Scattering:
◎ No more than 150 cpm
○ 150 cpm to 250 cpm
Δ 250 cpm to 400 cpm
X No less than 400 cpm

TABLE 4

| Example | Inital stage Q/M | Inital stage Fogging | Inital stage Image quality | Inital stage Cleaning property | 1,000 copies Q/M | 1,000 copies Fogging | 5,000 copies Q/M | 5,000 copies Fogging | 10,000 copies Q/M | 10,000 copies Fogging | 50,000 copies Q/M | 50,000 copies Fogging | Comment |
|---|---|---|---|---|---|---|---|---|---|---|---|---|---|
| 1 | −14 | ◎ | ◎ | ○ | −14 | ◎ | −14 | ◎ | −13 | ◎ | −13 | ◎ | |
| 2 | −14 | ◎ | ◎ | ○ | −14 | ◎ | −14 | ◎ | −14 | ◎ | −14 | ◎ | |
| 3 | −14 | ◎ | ◎ | ○ | −14 | ◎ | −13 | ◎ | −13 | ◎ | −13 | ◎ | |
| 4 | −15 | ◎ | ◎ | ○ | −15 | ◎ | −14 | ◎ | −14 | ◎ | −14 | ◎ | |
| 5 | −15 | ◎ | ◎ | ○ | −15 | ◎ | −14 | ◎ | −14 | ◎ | −13 | ◎ | |
| 6 | −15 | ◎ | ◎ | ○ | −15 | ◎ | −15 | ◎ | −15 | ◎ | −14 | ◎ | |
| 7 | −14 | ◎ | ◎ | ○ | −14 | ◎ | −13 | ◎ | −13 | ◎ | −12 | ○ | |

TABLE 4-continued

| Example | Inital stage Q/M | Fogging | Image quality | Cleaning property | 1,000 copies Q/M | Fogging | 5,000 copies Q/M | Fogging | 10,000 copies Q/M | Fogging | 50,000 copies Q/M | Fogging | Comment |
|---|---|---|---|---|---|---|---|---|---|---|---|---|---|
| 8 | −13 | ◎ | ◎ | ○ | −13 | ◎ | −12 | ◎ | −12 | ◎ | −11 | ○ | |
| 9 | −14 | ◎ | ◎ | ○ | −13 | ◎ | −13 | ◎ | −13 | ◎ | −12 | ◎ | |
| 10 | −15 | ◎ | ◎ | ○ | −15 | ◎ | −14 | ◎ | −15 | ◎ | −15 | ◎ | |
| 11 | −14 | ◎ | ◎ | ○ | −14 | ◎ | −13 | ◎ | −13 | ◎ | −14 | ◎ | |
| 12 | −14 | ◎ | ◎ | ○ | −14 | ◎ | −13 | ◎ | −14 | ◎ | −13 | ◎ | |
| 13 | −13 | ◎ | ◎ | ○ | −13 | ◎ | −12 | ◎ | −12 | ◎ | −12 | ○ | |
| 14 | +19 | ◎ | ◎ | ○ | +19 | ◎ | +19 | ◎ | +18 | ◎ | +18 | ◎ | |
| 15 | +18 | ◎ | ◎ | ○ | +18 | ◎ | +18 | ◎ | +17 | ◎ | +18 | ◎ | |
| 16 | −14 | ◎ | ◎ | ○ | −14 | ◎ | −14 | ◎ | −13 | ◎ | −13 | ◎ | |
| Comparative Example | | | | | | | | | | | | | |
| 1 | −11 | ◎ | X | X | −10 | ○ | −10 | ○ | −10 | ○ | −10 | ○ | Insufficient irregularities |
| 2 | −12 | ◎ | ○ | ◎ | −11 | Δ | −8 | X | −5 | X | −4 | X | Minute particles separated |
| 3 | −10 | ○ | X | X | −9 | ○ | −9 | ○ | −8 | ○ | −9 | ○ | Insufficient irregularities |
| 4 | −8 | ○ | X | X | −7 | Δ | −5 | X | −4 | X | −4 | X | Minute particles separated |
| 5 | −9 | ○ | X | Δ | −8 | Δ | −6 | X | −4 | X | −4 | X | Minute particles separated |
| 6 | −6 | X | X | X | −6 | X | −6 | X | −7 | X | −6 | X | Smooth surface |
| 7 | −10 | ◎ | X | Δ | −9 | Δ | −9 | Δ | −8 | Δ | −8 | X | Insufficient irregularities |
| 8 | −9 | ○ | ○ | ○ | −8 | ○ | −8 | Δ | −6 | X | −5 | X | Minute particles separated |
| 9 | −8 | Δ | X | X | −8 | Δ | −7 | X | −7 | X | −7 | X | Smooth surface |
| 10 | −5 | X | X | X | −5 | X | −4 | X | −4 | X | −4 | X | Smooth surface |

(In the case of the developing agents using the toners of Comparative Examples 1, 3 to 7,9 and 10, the test for printability could hot be conducted because no thorough cleaning of residual toner was obtained in the initial stage.)
*Cleaning property:
○ Satisfactory cleaning
X Defective cleaning As described above, this invention resides in an electrostatic latent image developing toner comprising spherical core particles composed of at least a coloring agent and a thermoplastic resin and an outer shell layer containing at least a thermoplastic resin and applied in the form of a coating fast to the core particles, which electrostatic latent image developing toner is characterized by the fact that the outer shell layer applied is the form of a coating in formed by thermally fixing minute particles of a first thermoplastic resin and minute particles of a second thermoplastic resin satisfying the following conditional formulas I to IV on the surface of the core particles thereby enabling part of the minute particles of the second thermoplastic resin to retain the original particulate form thereof intact in the produced coating and impart a minutely rugged surface to the coating. This toner, therefore, is excellent in flowability and sufficient in charging property, amount of development, and cleaning property and, in spite of a small diameter, capable of stably producing an image of fine delineation and high quality without inducing such drawbacks as drift of toner particles and fogging of a developed image.

Further this invention resides in an electrostatic latent image developing toner comprising spherical core particles composed of at least a coloring agent and a thermoplastic resin and an outer shell layer containing at least a thermoplastic resin and applied in the form of a coating fast to the core particles, which electrostatic latent image developing toner is characterized by the fact that the outer shell layer is formed by thermally fixing minute particles of a thermoplastic resin and minute particles of a thermosetting resin or minute particles of a resin having a gelling component (gel) in an amount in the range of $60<\text{gel}<100$ on the surface of the core particles thereby enabling the minute particles of the thermosetting resin or the miute particles of the resin having a gelling component (gel) in an amount in the range of $60<\text{gel}<100$ to retain the original particulate form thereof intact in the produced coating and impart a minutely rugged surface to the coating.

What is claimed is:

1. An electrostatic latent image developing toner comprising spherical core particles composed of at least a coloring agent and a thermoplastic resin and an outer shell layer containing at least a thermoplastic resin and applied in the form of a coating fast to said core particles, said outer shell layer applied in the form of a coating is formed by thermally fixing minute particles of a first thermoplastic resin and minute particles of a second thermoplastic resin satisfying the following conditional formulas I to IV on the surface of said core particles thereby enabling part of the minute particles of said second thermoplastic resin to retain the original particulate form thereof intact in the produced coating and impart a minutely rugged surface to said coating;

$$-0.2 \leqq R \leqq 0.6 \quad \text{(I)}$$

$$-15 \leqq \Delta Tm \leqq 100 \quad \text{(II)}$$

$$-4 \leqq \Delta gel \leqq 60 \quad \text{(III)}$$

$$|100\ R + \Delta Tm + 4\ \Delta gel|\ 20 \quad \text{(IV)}$$

providing that in the expressions $$R = (R_2 - R_1)/(R_2 + R_1)$$

$$\Delta Tm = Tm_2 - Tm_1$$

$\Delta gel = gel_2 - gel_1$ $R_1$ and $R_2$ are average particle diameters (micron) respectively of the minute particles of said first thermoplastic resin and the minute particles of said second thermoplastic resin, $Tm_1$ and $Tm_2$ are the softening points (°C.) respectively of the minute particles of the first thermoplastic resin and the minute particles of the second thermoplastic resin, and $gel_1$ and $gel_2$ are amounts of gel formed (% by weight) respectively of the minute particles of the first thermoplastic resin and the minute particles of said second thermoplastic resin.

2. A toner according to claim 1, wherein the average particle diameter of said core particles is no more than 14 microns.

3. A toner according to claim 1, wherein the glass transition point of said core particles is no more than 70° C.

4. A toner according to claim 1, wherein the softening point of said core particles is no more than 180° C.

5. A toner according to claim 1, wherein the average particle diameter of the minute particles of said first and second thermoplastic resins is in the range of 1/100 to 1/5 of the average particle diameter of said core particles.

6. A toner according to claim 1, wherein the average particle diameter of the minute particles of said first thermoplastic resin is in the range of 0.05 to 3 microns.

7. A toner according to .claim 1, wherein the average particle diameter of the minute particles of said second thermoplastic resin is in the range of 0.4 to 3 microns.

8. A toner according to claim 1, wherein the glass transition point of the minute particles of said first and second thermoplastic resins is in the range of 50° to 180° C.

9. A toner according to claim 1, wherein the softening point of the minutes particles of said first and second thermoplastic resins is in the range of 70° to 200° C.

10. A toner according to claim 1, wherein the amount of the minute particles of said first and second thermoplastic resins to be added is in the range of 8 to 50 parts by weight, based on 100 parts by weight of said core particles.

11. A toner according to claim 1, wherein the amount of the minute particles of said second thermoplastic resin to be added is in the range of 5 to 100 parts by weight, based on 100 parts by weight of the minute particles of said first thermoplastic resin.

12. An electrostatic latent image developing toner comprising spherical core particles composed of at least a coloring agent and a thermoplastic resin and an outer shell layer containing at least a thermoplastic resin and applied in the form of a coating fast to said core particles, said outer shell layer is formed by thermally fixing first minute particles of a thermoplastic resin and second minute particles of a thermosetting resin or a resin having a gelling component (gel) in an amount in the range of $60 < gel < 100$ on the surface of said core particles thereby enabling the second minute particles to retain the original particulate form thereof intact in the produced coating and impart a minutely rugged surface to said coating, said first minute particles of the thermoplastic resin having a softening point which is in the range of 70° to 200° C. and which soften to fix said second minute particles.

13. A toner according to claim 12, wherein the average particle diameter of said core particles is no more than 14 microns.

14. A toner according to claim 12, wherein the glass transition point of said core particles is no more than 70° C.

15. A toner according to claim 1, wherein the softening point of said core particles is no more than 180° C.

16. A toner according to claim 12, wherein the softening point of the minute particles of said core particles is no more than 180° C.

17. A toner according to claim 12, wherein the average particle diameter of the first minute particles of said thermoplastic resin, the second minute particles of said thermosetting resin or said resin having a gelling component (gel) in an amount in the range of $60 < gel < 100$ is in the range of 1/100 to 1/5 of the average particle diameter of said core particles.

18. A toner according to claim 12, wherein the average particle diameter of the first minute particles of said thermoplastic resin is in the range of 0.05 to 3 microns.

19. A toner according to claim 12, wherein the average particle diameter of the second minute particles of said thermosetting resin or said resin having a gelling component (gel) in an amount in the range of $60 < gel < 100$ is in the range of 0.4 to 3 microns.

20. A toner according to claim 12, wherein the amount of the first minute particles of said thermoplastic resin to be added is in the range of 8 to 30 parts by weight, based on 100 parts by weight of said core particles.

21. A toner according to claim 12, wherein the amount of the second minute particles of said thermosetting resin or said resin having a gelling component (gel) in an amount in the range of $60 < gel < 100$ is in the range of 5 to 100 parts, by weight based on 100 parts by weight of the first minute particles of said thermoplastic resin.

* * * * *

UNITED STATES PATENT AND TRADEMARK OFFICE

CERTIFICATE OF CORRECTION

PATENT NO. : 4,980,257

DATED : December 25, 1990

INVENTOR(S) : Masahiro ANNO, et al.

It is certified that error appears in the above-identified patent and that said Letters Patent is hereby corrected as shown below:

Formula (IV) in claim 1 of column 30 is changed from

"$|100R+\Delta Tm+4\Delta gel|20$"

to

--$|100R+\Delta Tm+4\Delta gel|\geqq 20$--

Signed and Sealed this

First Day of September, 1992

*Attest:*

DOUGLAS B. COMER

*Attesting Officer*

*Acting Commissioner of Patents and Trademarks*